US005951821A

United States Patent [19]

Laapotti

[11] Patent Number: 5,951,821

[45] Date of Patent: Sep. 14, 1999

[54] ARRANGEMENT AND METHOD FOR TRANSFERRING A WEB IN A PAPER MACHINE FROM A TWO-FELT PRESS NIP TO A DRYER SECTION

[75] Inventor: Jorma Laapotti, Palokka, Finland

[73] Assignee: Valmet Corporation, Helsinki, Finland

[21] Appl. No.: 09/160,896

[22] Filed: Sep. 25, 1998

Related U.S. Application Data

[62] Division of application No. 08/825,693, Apr. 2, 1997, Pat. No. 5,888,354.

[30] Foreign Application Priority Data

Apr. 4, 1996 [FI] Finland ..... 961518

[51] Int. Cl.[6] ..... D21F 3/04

[52] U.S. Cl. ..... 162/205; 162/359.1; 162/360.2

[58] Field of Search ..... 162/205, 359.1, 162/360.2, 360.3, 306

[56] References Cited

U.S. PATENT DOCUMENTS

| | | | |
|---|---|---|---|
| 2,714,342 | 8/1955 | Beachler | 162/370 |
| 3,268,390 | 8/1966 | Ely, Sr. | 162/360.2 |
| 3,607,626 | 9/1971 | Nilsson | 162/358.1 |
| 3,861,996 | 1/1975 | Dorfel | 162/360.3 |
| 3,981,084 | 9/1976 | Sobota | 162/360.2 |
| 4,483,745 | 11/1984 | Wicks et al. | 162/205 |
| 4,526,655 | 7/1985 | Karvinen et al. | 162/360 |
| 4,561,939 | 12/1985 | Justus | 162/360 |
| 4,566,946 | 1/1986 | Koponen et al. | 162/359 |
| 4,648,942 | 3/1987 | Wanke et al. | 162/286 |
| 4,714,523 | 12/1987 | Sawyer, Jr. et al. | 162/371 |
| 4,861,430 | 8/1989 | Andersson | 162/205 |
| 4,915,790 | 4/1990 | Dahl | 162/305 |
| 4,931,143 | 6/1990 | Karvinen et al. | 162/360 |
| 4,943,351 | 7/1990 | Wedel | 162/205 |
| 4,988,410 | 1/1991 | Meinecke et al. | 162/360 |
| 5,037,509 | 8/1991 | Wedell | 162/359.1 |
| 5,087,325 | 2/1992 | Page | 162/193 |
| 5,169,501 | 12/1992 | Meinecke | 162/359 |
| 5,240,563 | 8/1993 | Karvinen et al. | 162/360.3 |
| 5,368,697 | 11/1994 | Steiner et al. | 162/360.2 |
| 5,468,349 | 11/1995 | Schiel | 162/358.3 |
| 5,662,778 | 9/1997 | Laapotti | 162/360.2 |

FOREIGN PATENT DOCUMENTS

| | | |
|---|---|---|
| 2034829 | 12/1994 | Canada . |
| 0159280 | 9/1989 | European Pat. Off. . |
| 0344088 | 4/1994 | European Pat. Off. . |
| 0496965 | 4/1995 | European Pat. Off. . |
| 84194 | 7/1991 | Finland . |
| 950451 | 2/1995 | Finland . |
| 951934 | 4/1995 | Finland . |
| 9206340 | 9/1992 | Germany . |
| 4227000 | 12/1992 | Germany . |
| 8808051 | 10/1988 | WIPO . |
| 9516821 | 6/1995 | WIPO . |

*Primary Examiner*—Karen M. Hastings
*Attorney, Agent, or Firm*—Steinberg & Raskin, P.C.

[57] ABSTRACT

An arrangement and method for transferring a paper web in high-speed paper machines having a press section arranged between a web former and a dryer section. In the press section, there is one or more press nip zones dewatering the web, at least the last one of which is preferably an extended nip through which at least two press fabrics that receive water are passed. The web is passed between the press fabrics through the last extended-nip zone so that the draining of water out of the web takes place through both faces of the web. After the last press nip zone, the web follows one of the fabrics passing through the last extended-nip zone by the effect of a difference in pressure avoiding rewetting of the web. The fabric carrying the web is passed through a gently loaded transfer nip zone in which the web is transferred onto a transfer surface more adhesive than the face of the fabric. The web is transferred on this transfer surface as a closed draw onto the drying wire or equivalent in the dryer section following after the press section.

20 Claims, 5 Drawing Sheets

ARRANGEMENT AND METHOD FOR TRANSFERRING A WEB IN A PAPER MACHINE FROM A TWO-FELT PRESS NIP TO A DRYER SECTION

CROSS REFERENCE TO RELATED APPLICATION

This application is a divisional of U.S. patent application Ser. No. 08/825,693 filed Apr. 2, 1997 now U.S. Pat. No. 5,888,354.

FIELD OF THE INVENTION

The present invention relates to an arrangement for transferring a paper web in high-speed paper machines which includes a press section arranged between a web former and a dryer section. In the press section, there is one or more press nip zones which dewater the web, at least the last nip zone preferably being an extended nip through which at least two press fabrics that receive water are passed. The web is passed between the press fabrics through the last extended-nip zone so that in the nip zone, the draining of water out of the web takes place through both faces of the web.

The present invention also relates to method for transferring a paper web in high-speed paper machines which include a press section arranged between a web former and a dryer section.

BACKGROUND OF THE INVENTION

One of the most important quality requirements of all paper and board grades is uniformity of the structure both on the micro scale and on the macro scale. The structure of paper, in particular of printing paper, must also be symmetric. The desired printing properties required from printing paper mean good smoothness, evenness, and certain absorption properties of both faces. The properties of paper, in particular the symmetry of density, are affected to a considerable extent by the operation of the press section of the paper machine, which operation also has a decisive significance for the uniformity of the profiles of the paper in the cross direction and in the machine direction.

Increased running speeds of paper machines create new problems to be solved, which problems are mostly related to the runnability of the machine. Currently, running speeds of up to about 1500 meters per minute are employed. At these speeds, so-called closed press sections, which comprise a compact combination of press rolls positioned around a smooth-faced center roll, usually operate satisfactorily. As examples of such compact press sections reference is made to the current assignee's Sym-Press II™ and Sym-Press O™ press sections.

From the point of view of energy economy, dewatering taking place by pressing is preferable to dewatering taking place by evaporation. For this reason, attempts should be made to remove a maximum amount of water out of the paper web by pressing in order that the proportion of water to be removed out of the paper web by evaporation may be made as small as possible.

Increased running speeds of paper machines, however, create new, so far unsolved problems expressly for the dewatering taking place by pressing, because the press impulse applied when dewatering by pressing cannot be increased sufficiently by the means known from the prior art, above all because at high web running speeds, the nip times remain inadequately short and, on the other hand, the peak pressure of pressing cannot be increased beyond a certain limit without destruction of the structure of the web.

With increasing running speeds of paper machines, the problems of runnability of a paper machine are also manifested with further emphasis, because a web with a high water content and low strength does not withstand an excessively high and sudden impulse of compression pressure or the dynamic forces produced by high speeds, but web breaks and other operational disturbances arise which result in standstills and in considerable economic losses.

Further problems which are manifested with increased emphasis at high web running speeds of paper machines and for which satisfactory solutions have not been found so far, at least not for all of the problems, include problems of quality related to the requirements of uniformity of the machine-direction and cross-direction property profiles of the paper web. The uniformity of the web that is being produced also affects the runnability of the whole paper machine, and it is also an important quality factor in finished paper, which factor is emphasized with respect to copying and printing papers with higher speeds of copying and printing machines and with increased requirements concerning the uniformity of the printing quality.

The machine-direction property profiles of the paper produced are also affected significantly by oscillations in the press sections, and the variations of properties in the cross direction are affected by the cross-direction profiles of the nip pressures in the press nips. These profile problems tend to be increased considerably with increasing running speeds of the machine.

In recent years, speeds even as high as about 40 meters per second (about 2400 meters per minute) have been contemplated as running speeds of paper machines. The achievement of speeds as high as this, in particular in wide machines, results in ever more difficult problems to be solved, of which problems the most important ones are the runnability of the machine and an adequate dewatering capacity at a high web speed.

With respect to the patent literature most closely related to and connected with the present invention, reference is made to the following publications:

- Finnish Patent Nos. 81,854 (corresponding to U.S. Pat. No. 4,526,655), 82,500, 85,044 (corresponding to U.S. Pat. No. 4,861,430), and 93,563 (corresponding to International Publication No. WO 88/08051);
- Finnish Patent Application Nos. 842115 (corresponding to U.S. Pat. No. 4,931,143), 950451 (filed Feb. 2, 1995), and 951934 (filed Apr. 24, 1995);
- U.S. Pat. Nos. 4,483,745, 4,561,939, 4,648,942, 4,915,790, 4,943,351, 4,988,410, 5,087,325, 5,169,501, and 5,368,697;
- European Patent Publication Nos. 0 159 280 B1, 0 344 088 A2, and 0 496 965 B1;
- German Patent Publication Nos. 36 04 522 A1 (corresponding to Finnish Patent No. 82,500), 37 42 848 A1 (corresponding to U.S. Pat. No. 4,915,790), 42 27 000 A1, 44 02 629 A1;
- International Publication Nos. WO 88/08051 (corresponding to Finnish Patent No. 93,563) and 95/16821; and
- Canadian Patent Application No. 2,034,829.

Further, reference is made to the constructions illustrated in the accompanying FIGS. 8A and 8B, mainly included in the prior art and available at least to the current assignee.

In the prior art press sections, in particular in press sections meant for producing printing papers, the last press nip is generally a single-felt nip, and the transfer of the web after the last nip has taken place so that the web is separated from the press felt of the last nip and is transferred on a smooth face of the press roll, from which roll face the web is separated and transferred as an open and unsupported draw onto the drying wire. The free draw is advantageous in view of the difference in speed needed in order to maintain a web tension, but the open draw causes a considerable risk of web breaks, in particular at higher speeds, so that free draws can, as a rule, not be employed at speeds higher than about 1700 meters per minute. The use of a single-felt last nip may also cause the drawback that the web becomes asymmetric in respect of the smoothness properties of its opposite faces because the face of the web that is pressed against the smooth press roll in the last nip receives a higher smoothness than the opposite web face, which was placed against the water-receiving felt. The unequalsided draining of water taking place in the last nip can also distort the distribution of fillers and fines in the web. Thus, the single-felt last press nip in the prior art press sections tends to produce a poor symmetry of roughness in particular with fine paper and with LWC and MWC base paper.

This problem is exacerbated when the press impulse is high, as is the case in an extended-nip press in the last press position. For example, with MWC base paper, in the current assignee's test paper machine, a non-calendered ratio of 0.52 was obtained for Bendtsen roughness of top side to bottom side when the press load was, in a "Sym-Belt S"™ press, about 800 kN per meter, when the length of the press shoe was about 152 mm, and when the smooth press roll was placed in the upper position in the single-felt press nip. The extensive asymmetry of roughness constitutes a limitation for the magnitude of the press loading, for the dry solids content that can be attained, and for the wet strength.

It is known from the prior art to use what are called equalizing presses in connection with various press sections, also extended-nip press sections, by means of which equalizing presses attempts are made to equalize the above asymmetry of roughness. With respect to these prior art equalizing presses, reference is made, for example, to the current assignee's Finnish Patent No. 64,823 (corresponding to U.S. Pat. No. 4,566,946), to published German Patent Application No. 43 21 406 A1 in the name of Messrs. J. M. Voith GmbH (corresponding to U.S. Pat. No. 5,468,349), and to German Utility Model No. G 92 06 340.3 in the name of Messrs. Sulzer-Escher Wyss GmbH. By means of the equalizing presses known from the above publications, it has, however, not been possible to provide satisfactory solutions for the problems related to asymmetry of roughness, in particular not in connection with supported transfer and closed draw of the web.

The prior art includes a number of arrangements in which the transfer of the web from one fabric onto another fabric, or further along the web formation path, or ensuring that the web follows exactly the press fabric that is supposed to carry the web further has been accomplished by means of a transfer suction roll or some other suction device. However, it is a drawback of the use of these suction devices that they cause rewetting of the web because of their suction effect. This rewetting is particularly detrimental in particular after the last nip in the press section, in which nip the web is already relatively dry and capable of absorption and, thus, particularly susceptible to rewetting. The risk of rewetting has imposed considerable restrictions for the use of transfer suction devices and for the application of vacuums sufficiently high in view of the transfer of the web.

In the press section of a paper machine, for the transfer of the web, various transfer belts are also employed, which do not substantially receive water and which are substantially impenetrable, the operation of these transfer belts being based mainly on their surface properties, because a suction effect that promotes or guarantees the transfer of the web cannot be applied to the web through such belts.

OBJECTS AND SUMMARY OF THE INVENTION

Accordingly, a general object of the present invention is further development of the prior art mentioned above so that the drawbacks discussed above are substantially avoided and that the objectives of the invention mentioned above and those that will come out later are achieved.

Another object of the present invention is to provide a novel arrangement of equipment and a novel method for the transfer of the web from the last press nip in the press section to the dryer section following the press section.

It is a particular object of the invention to provide such an arrangement and method for web transfer in connection with which a two-felt extended nip can be applied advantageously as the last nip, in which nip the dewatering takes place substantially symmetrically through both faces of the web so that symmetric distributions of surface properties and density of the web are achieved.

In view of the achieving the objects mentioned above and others, in a first embodiment of the arrangement of a web transfer device in accordance with the invention, after the last extended-nip zone in the press section, the web has been arranged to follow one of the fabrics passing through the last extended-nip zone by the effect of a difference in pressure and so as to provide a substantially non-rewetting web engagement, and that the last-mentioned fabric is passed through a relatively gently loaded transfer nip zone. In this transfer nip zone, the web is transferred onto a transfer face substantially more adhesive than the face of the last-mentioned fabric. More particularly, the web is transferred on the transfer face as a closed draw onto the drying wire or equivalent in the dryer section following after the press section.

In a second embodiment of the arrangement of a web transfer device in accordance with the invention, after the last extended-nip zone the web has been arranged to follow one of the fabrics passing through the last extended-nip zone by the effect of a difference in pressure substantially not rewetting the web. After the suction device that produces the difference in pressure mentioned above, the web is transferred on the press fabric, substantially over the whole distance of transfer, under the holding effect of the vacuum in the suction device or devices, onto the suction zone of the transfer suction roll of the drying wire of the dryer section following after the press section and, by the effect of the suction zone, further onto the support of the drying wire.

By means of the present invention, a reliable but non-rewetting transfer of the web is achieved from the last two-felt extended nip in a press section, in which nip a substantially symmetric draining of water has been accomplished through both faces of the web.

In one particularly notable embodiment of the arrangement for transferring a paper web in high-speed paper machines in accordance with the invention, the arrangement includes separating means for separating the first press fabric from the web after the extended nip zone such that the web is subsequently carried only on the second press fabric after the extended nip zone, and first transfer means for transferring the web after the extended nip zone from the second press fabric to a transfer surface which is structured and arranged such that the web has a greater adhesiveness thereto than to the second press fabric. The web is transferred from the transfer surface as a closed draw onto a drying wire in the dryer section. The separating means may comprise a transfer suction roll or transfer suction box which generates a pressure difference to effect the separation of the first press fabric from the web and the subsequent carrying of the web only on the second press fabric such that the web is not rewet through contact with the first press fabric after the separation of the first press fabric from the web. The first transfer means may comprise a transfer nip zone through which the second press fabric carrying the web therewith passes.

Another embodiment of the arrangement in accordance with the invention includes separating means for separating the first press fabric from the web after the extended nip zone such that the web is subsequently carried only on the second press fabric after the extended nip zone, the separating means comprising first suction means arranged in a loop of the second press fabric for generating a pressure difference to effect the separation of the first press fabric from the web such that the web is subsequently carried only on the second press fabric and is not rewet through contact with the first press fabric after the separation of the first press fabric from the web, a transfer suction roll including a suction zone over which the drying wire runs to receive the web and carry it into and partially through the dryer section, the web being transferred to the drying wire at a transfer point in the suction zone of the transfer suction roll, and suction means arranged in the loop of the second press fabric between the first suction means and the transfer point for maintaining the web on the second press fabric substantially over the entire distance between the first suction means and the transfer point.

In a method disclosed herein, during constant running of the paper machine, in the suction zones of the transfer suction devices, sufficiently low vacuum levels and small angles of change in direction are applied so that it is possible to employ differences in speed needed for tightening the web. In this manner, the lowering of the dry solids content, i.e., rewetting, of the web produced by the transfer suction devices after the extended nip is also reduced. The transfer of the web onto the face of the correct felt can also be achieved by means of differences in the faces of the rolls, in consideration of the fact that a smooth roll produces a higher after-suction than a hollow-faced roll does, or by making use of different web-adhering capacities of different fabrics.

The web transfer in accordance with the invention is preferably accomplished so that, at least in constant running, the web has a particularly linear run and closed draw through the whole press section, so that the largest angle of change in direction is smaller than about 15°.

More particularly, in one embodiment of the method disclosed herein for transferring a web from a last press nip in the press section of a paper machine to a drying wire in a dryer section of the paper machine as a closed draw during threading and constant running of the web, the web is carried through the last press nip between first and second fabrics and is separated from the first fabric after the last press nip over a first transfer suction roll or a transfer suction box such that it is subsequently carried on only the second fabric. The method entails the steps of providing a higher suction level in a suction zone in the first transfer suction roll or transfer suction box during threading of the web in comparison to the suction level in the suction zone during constant running of the web, transferring the web from the second fabric to the drying wire by passing the drying wire over a second transfer suction roll into engagement with the web, and optionally providing a larger curve angle of the first fabric over the first transfer suction roll or transfer suction box during threading of the web in comparison to the curve angle during constant running of the web. Also, it is optional to provide a larger change in the running direction of the drying wire over the second transfer suction roll during threading of the web in comparison to the change in the running direction of the drying wire during constant running of the web. In certain embodiments, the first transfer suction roll or transfer suction box is arranged in a loop of the second fabric, and the size of a suction zone in the second transfer suction roll is selected such that an effective angle of the suction zone in the second transfer suction roll is larger than an angular change in the running direction of the drying wire over the suction zone in the second transfer suction roll. If a transfer suction roll is present to separate the first fabric from the web, contact of suction-sector sealing ribs of the transfer suction roll against an inner face of a mantle of the first transfer suction roll may be reduced by providing the suction-sector sealing ribs without water lubrication or with seal locking devices. To permit differences in speed necessary for tensioning the web and reduce rewetting of the web after the last nip, the suction level in the suction zone in the first transfer suction roll or transfer suction box and/or the lower change in the running direction of the drying wire over the second transfer suction roll are reduced during constant running of the web. With respect to particular ranges of pressure variation, the suction level in the suction zone in the first transfer suction roll or transfer suction box may be controlled during constant running of the web in a range from about −2 kPa to about −30 kPa, and the suction level in the suction zone of the first transfer suction roll or transfer suction box may be controlled during threading of the web in a range from about −5 kPa to about −45 kPa.

In the following, the invention will be described in detail with reference to some preferred exemplifying embodiments of the invention illustrated schematically in the figures in the accompanying drawing. The invention is in no way strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 7:
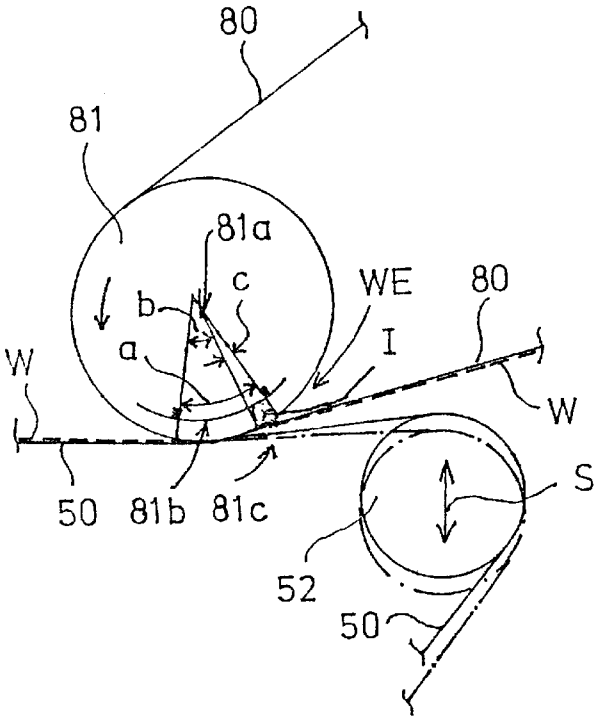
FIG. 7 shows a arrangement in accordance with the invention of the suction zones of a transfer suction roll placed inside the loop of the drying wire.
Figure 8A:
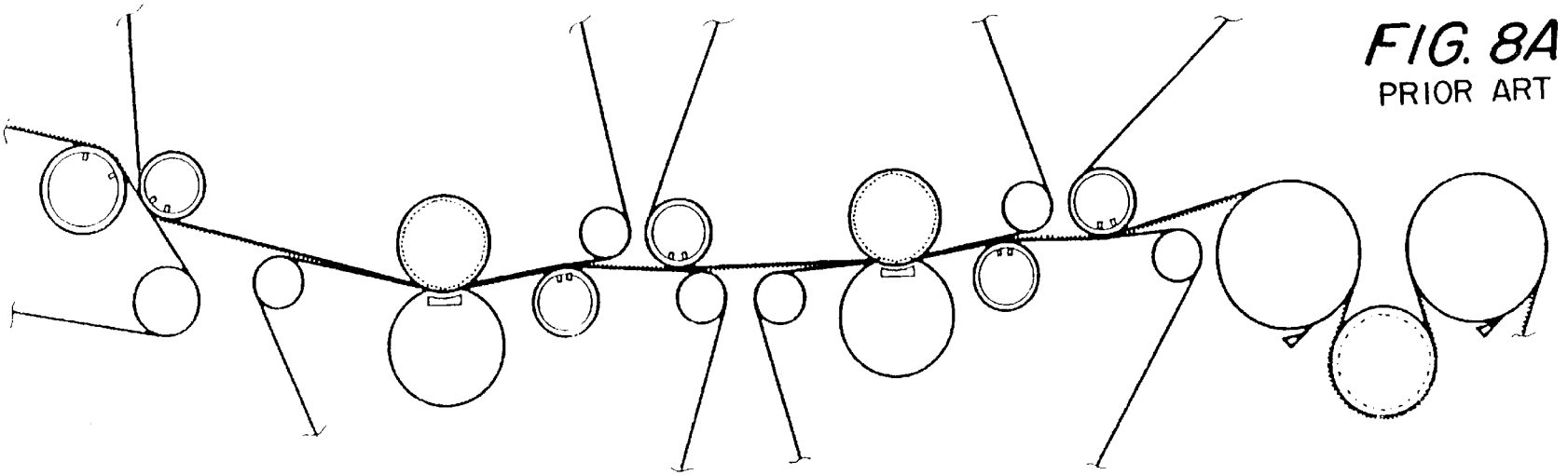
FIG. 8A PRIOR ART
FIGS. 8A and 8B illustrate prior art press section constructions known at least to the current assignee and mainly representing prior art related to the present invention.
Figure 8B:
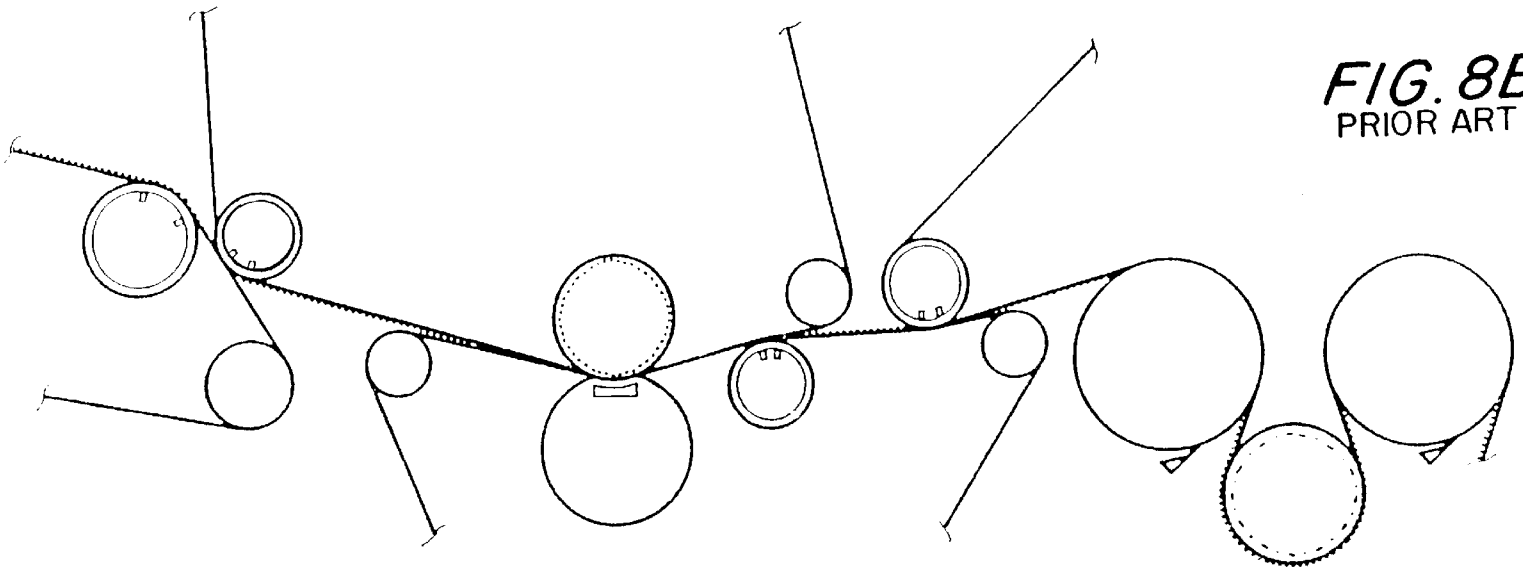
FIG. 8B PRIOR ART

Referring to the accompanying drawings wherein the same reference numerals refer to the same or similar elements, FIG. 8A illustrates an arrangement of a device for the transfer of a paper web from a press section to a dryer section, which is available at least to the current assignee and which is mainly included in the prior art, wherein the press section is provided with two extended nips and the web is transferred as a closed draw from the forming wire of the forming section preceding the press section to the drying wire. FIG. 8B is a similar illustration of a prior art transfer device arrangement arranged in connection with a press section provided with one extended nip and by whose means the web is transferred as a closed draw from the forming wire of the preceding forming section to the drying wire through the single extended-nip zone. FIGS. 8A and 8B are not provided with reference numerals, but the constructions illustrated in these figures will become clear after an examination of the exemplifying embodiments of the present invention illustrated in the accompanying FIGS. 1–7.

Initially, the common features of construction of the press section geometries as shown in FIGS. 1–4 will be described. As shown in FIGS. 1–4, the press section with a closed draw of a web W in a paper or board machine comprises a first water-receiving upper fabric 20. The web W is transferred onto the upper fabric 20 at a suction zone 21*a* of a pick-up roll 21 from a forming wire 10 at a pick-up point P after suction roll 11,11*a* arranged in the loop of the forming wire 10. After the pick-up point P, there follows a wire drive roll 12 from which the return run of the wire 10 starts. As shown in FIGS. 1–4, the press includes one or two successive press nips NP1 and NP2, which drain water out of the web W efficiently and between which the web W has a fully closed draw so that it is constantly supported by a fabric. In the embodiment shown in FIGS. 1–4, all dewatering press nips NP1 and NP2 are so-called extended nips, whose press zone is substantially longer than that of a sharp roll nip, although such extended nips are not essential to the practice of the invention. Also, in the embodiment shown in FIGS. 1 to 4, all press nips NP1 and NP2 are additionally provided with two water-receiving press fabrics 20,30;40,50, so that water is drained in these nips substantially symmetrically through both faces of the web W.

In the embodiments shown in FIGS. 1 to 4, the first upper fabric 20 is guided by alignment, tensioning and guide rolls 22,22S. The first extended nip NP1 includes a water-receiving lower fabric 30, which is guided by alignment, tensioning and guide rolls 32,32S. The first extended nip NP1, and also the second extended nip NP2, has been accomplished, for example, by means of the current assignee's Sym Belt Press™ press. The construction of the press is substantially such that the extended nip NP1 consists of a hose roll 35,55 provided with a flexible mantle 201 and of a backup roll 25,45. In the interior of the hose mantle 201, there is a hydrostatically and/or hydrodynamically lubricated glide shoe 210, and hydraulic loading devices placed in connection with the glide shoe press the shoe 210 against the backup roll 25,45. The backup roll 25,45 is a hollow-faced 25',45' press roll, for example the current assignee's adjustable-crown Sym-Z Roll™. Other extended nip press constructions may of course be utilized in the present invention without deviating from the scope and spirit thereof.

Figure 1:
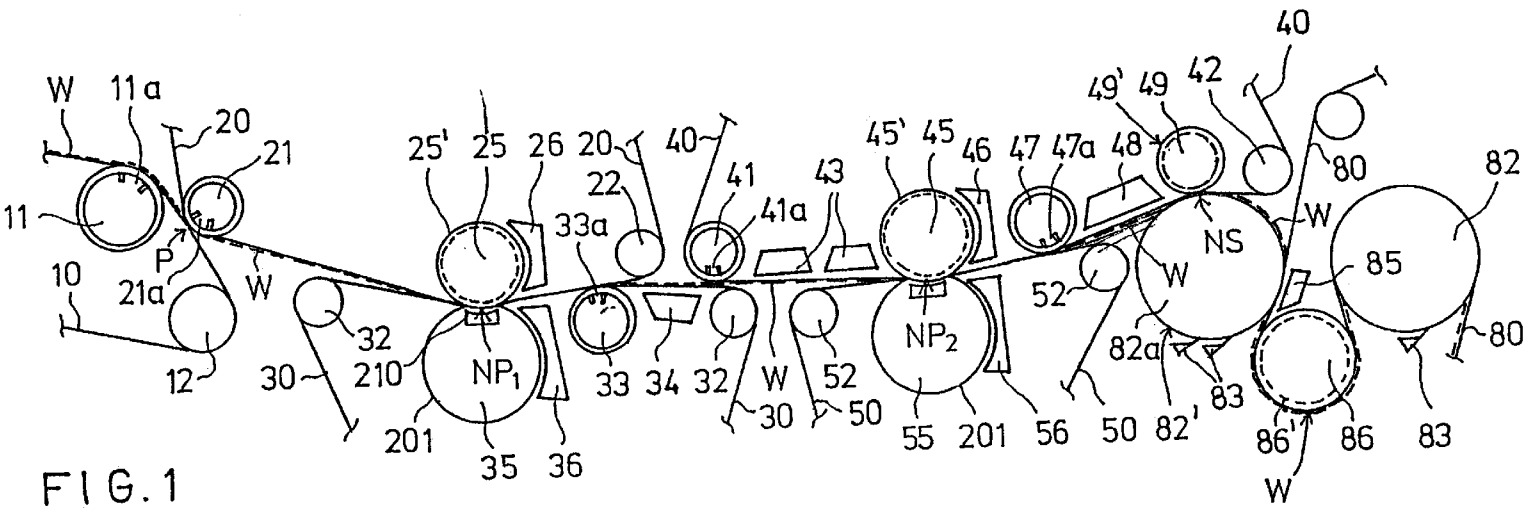
FIG. 1 shows an embodiment of the invention in which two successive extended-nip zones are employed.

As shown in FIG. 1, the press section includes a second upper fabric 40 which is guided by alignment, tensioning and guide rolls 42. The second extended nip NP2 is a two-felt nip and includes a lower fabric 50 which is guided by tensioning, alignment and guide rolls 52. The extended nip NP2 is formed between the mantle 201 of the lower hose roll 55 and its possible hollow face, if any, the press fabrics 40,50 and the upper hollow-faced 45' press roll 45.

Figure 2:
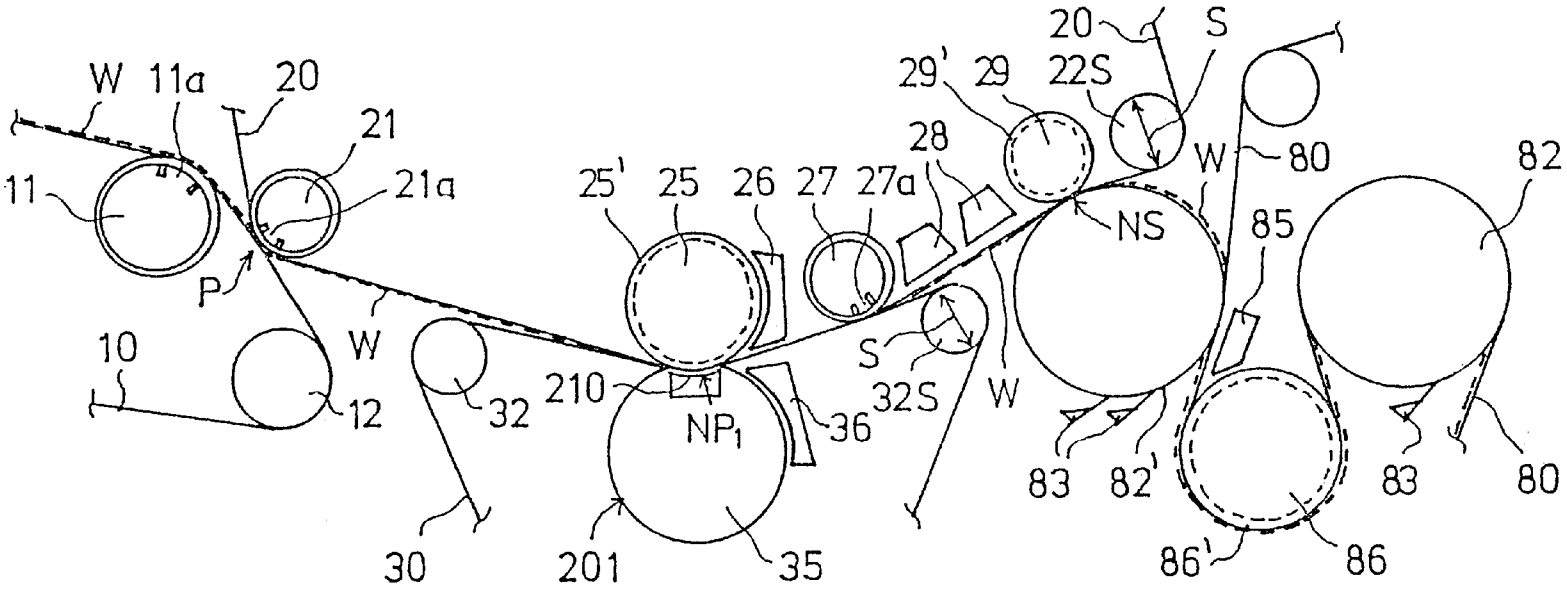
FIG. 2 shows a second exemplifying embodiment of the invention which is in most respects substantially similar to FIG. 1 except that a single extended-nip zone is used.
Figure 3:
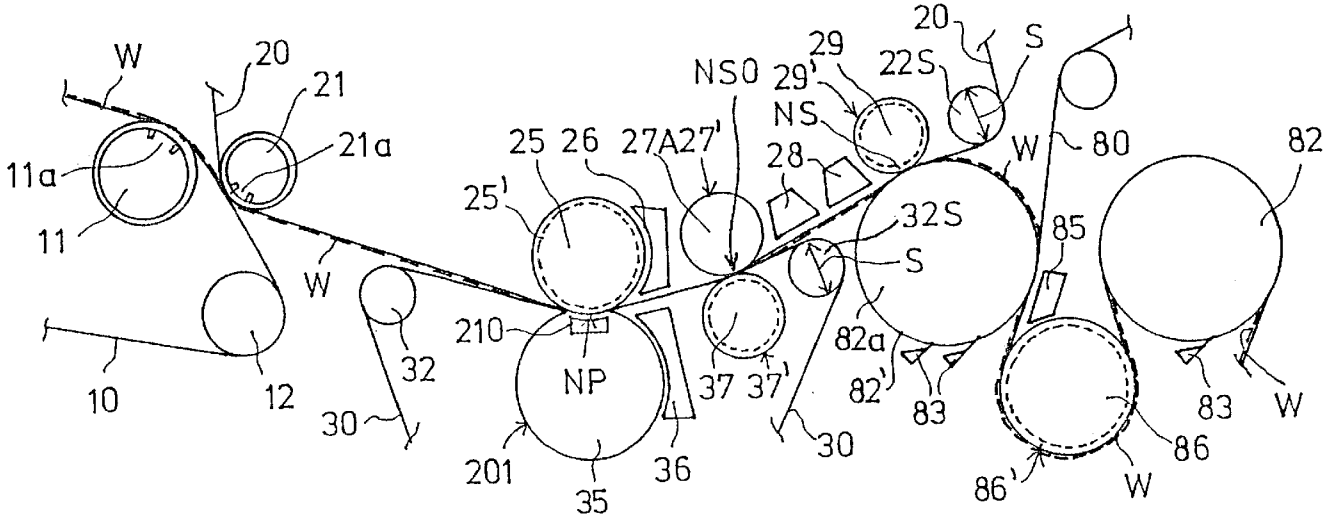
FIG. 3 shows such a third exemplifying embodiment of the invention in which one extended-nip zone is employed, after which the transfer of the web is ensured by means of a particular transfer nip.
Figure 4:
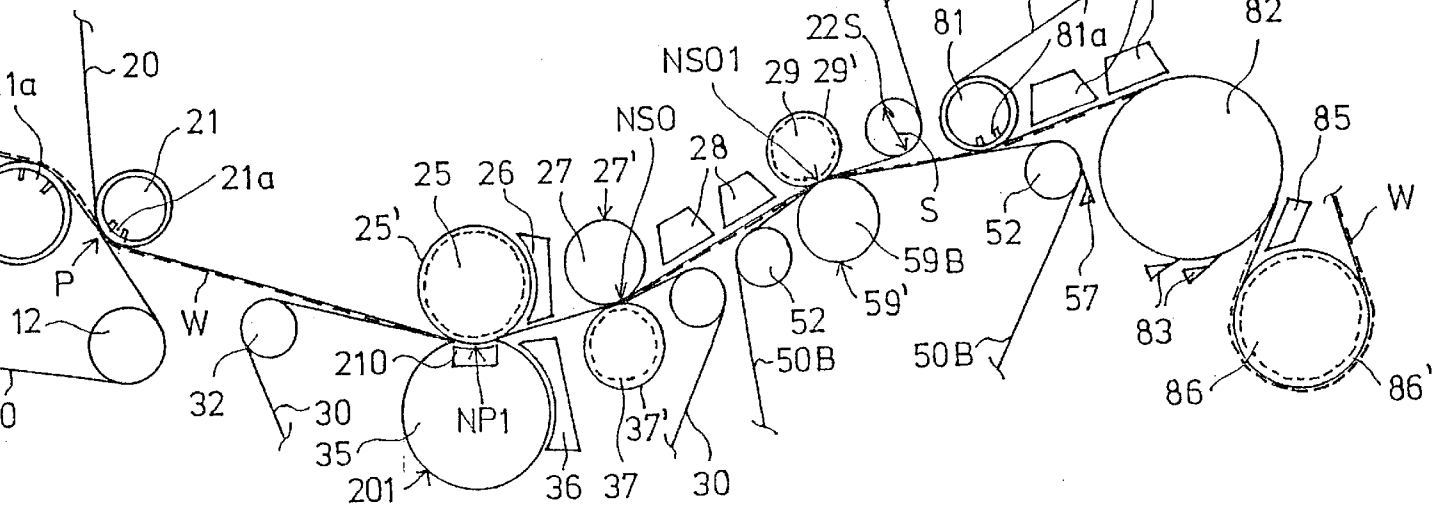
FIG. 4 shows a fourth exemplifying embodiment of the invention in which one extended nip zone is employed, which is followed by two successive transfer nips and by a particular transfer belt, on which the web is transferred onto the drying wire as a closed draw.

It is a feature common of the embodiments as shown in FIGS. 2, 3 and 4 that, in the press section, one extended-nip zone NP1 that dewaters the web W is employed, even though the transfer of the web W has been accomplished in different ways in the different illustrated embodiments in FIGS. 2, 3 and 4, compared with one another.

With respect to the transfer of the web W, it is a feature common of the embodiments as shown in FIGS. 1, 2 and 3 that the web W is transferred as a closed draw from the second upper fabric 40 (FIG. 1) or from the first upper fabric 20 (FIGS. 2 and 3) onto a smooth face 82' of a first drying cylinder 82*a* in the dryer section or a corresponding lead-in cylinder or roll by making use of a gently loaded transfer nip NS. This nip NS is formed by a hollow-faced 29',49' press roll arranged in the interior of the loop of the upper fabric 20,40 together with the first drying cylinder 82*a* or equivalent lead-in cylinder. Owing to the compression pressure applied in the transfer nip NS, the web W adheres to the smooth face 82' of the cylinder 82*a* and follows this face when the upper fabric 20,40 is separated from the web W by means of the guide roll 22S,42. Adhering to and running along the smooth face 82' of the cylinder 82*a*, the web W is carried into contact with the drying wire 80, which wire is in tangential contact with the cylinder 82*a* so that the web is between the wire 80 and the cylinder 82*a*. The web W is made to adhere to the drying wire 80 by means of a blow air device 85 or equivalent, after which the web W runs on the drying wire 80 at the side of the outside curve over a suction cylinder 86 provided with a grooved face 86' and subjected to a vacuum, for example the current assignee's VAC™ suction cylinder, and further onto the next drying cylinder 82 as a single-wire draw.

The first drying cylinder 82*a* and the subsequent drying cylinders 82 are provided with doctors 83 which keep their faces clean.

Unlike the web transfer described above in relation to FIGS. 1, 2 and 3, FIGS. 4, 5 and 6 illustrate a web transfer arrangement in which the web W is passed onto the drying wire 80 from the lower fabric 50,50B by means of a suction transfer roll 81 while making use of the vacuum present in a suction zone 81*a* of the suction transfer roll 81. After the suction transfer roll 81, it is ensured that the web W remains on the lower face of the drying wire 80 by means of blow-suction boxes 87 or equivalent, after which the web W is passed onto the first drying cylinder 82 and from it further, as a single-wire draw, in a manner in itself known.

In the following, the specific features differing from one another in the embodiments shown in FIGS. 1–7 will be described.

In FIG. 1, a transfer suction roll 33 is arranged in the interior of the lower-wire loop 30 after the first extended nip NP1, and by means of the vacuum effective in a suction zone 33*a* of the roll 33, it is ensured that the web W follows the lower felt 30 reliably and is separated from the upper felt 20. After the suction zone 33*a,* the continued adherence of the web W on the top face of the lower felt 30 is ensured by means of a suction box subjected to a vacuum or by means of a blow-suction box 34. After the suction box or blow-suction box 34, the web W is transferred on a suction zone 41*a* of a transfer suction roll 41 onto the second upper fabric 40. Instead of the transfer suction roll 33, it is possible to use a corresponding stationary suction shoe. If necessary, the transfer of the web W onto the lower felt 30 is also ensured by means of a suitable felt angle. In FIG. 1, the lower fabric 30 is separated from the web W while guided by the guide roll 32, after which the remaining of the web W on the lower face of the second upper fabric 40 is ensured by means of the vacuum in transfer suction boxes or blow-suction boxes 43. After this, the web W runs through the second extended nip zone NP2. After the extended nip NP2, the web W is arranged to follow the second upper felt 40 and to be separated from the second lower felt 50 by means of the vacuum present in the vacuum zone 47*a* of the transfer suction roll 47. The angles of the felts 40,50 on the transfer suction roll 47 are arranged appropriately in view of the transfer. After the transfer suction roll 47, the continued passage or remaining of the web W on the lower face of the second upper felt 40 is ensured by means of the vacuum in the transfer suction box or blow-suction box 48. After the transfer suction box 48, the web W enters into the transfer nip NS, in which a relatively low linear load is employed, which is generally of an order of from 0 kN per meter to about 40 kN per meter. After this, the run of the web W is similar to that described above.

Figure 1A:
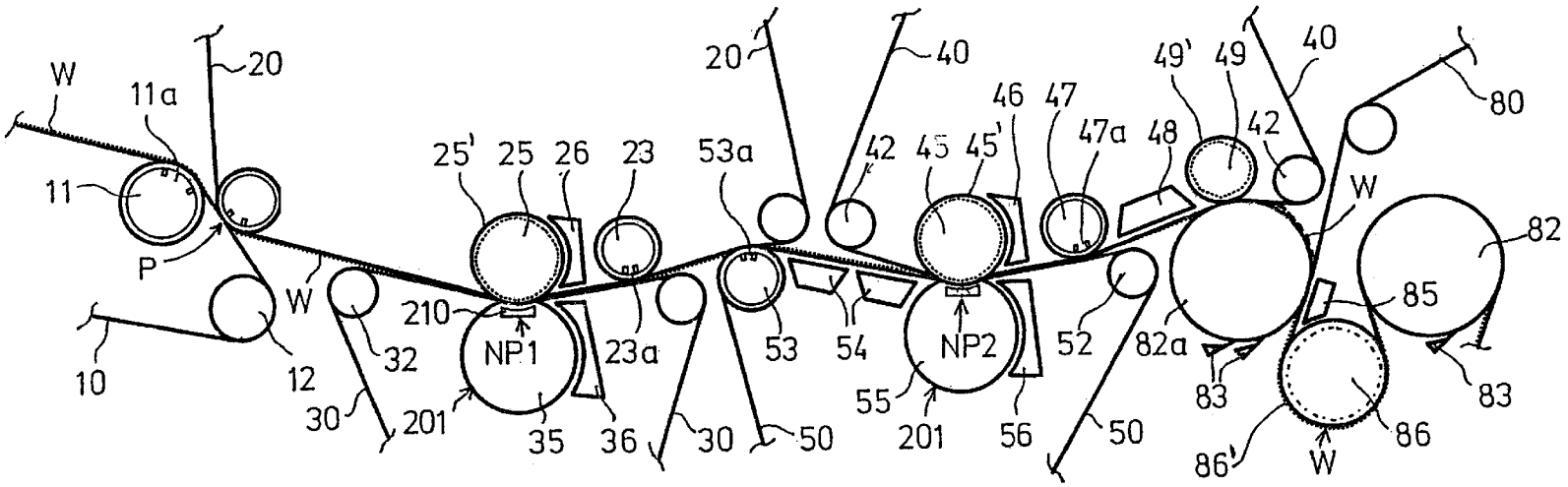
FIG. 1A illustrates a modification of the embodiment of the invention shown in FIG. 1.

FIG. 1A shows a modification of the press section shown in FIG. 1 and differs from that shown in FIG. 1 in the respect that the web W is transferred from the upper fabric 20 in the first extended nip NP1 onto the lower fabric 50 in the second extended nip NP2 while making use of the transfer suction roll 23 provided with a suction zone 23*a* and positioned inside the loop of the first upper fabric 20. By the effect of the suction zone 23*a,* the web W is separated from the lower fabric 30 and follows the lower face of the upper fabric 20, from which it is separated and transferred onto the lower fabric 50 of the second extended nip NP2 on the suction zone 53*a* of the transfer suction roll 53 positioned inside the loop of the lower fabric 50. After the transfer suction roll 53, the web W follows the top face of the lower fabric 50, while secured thereon by the vacuum in the transfer suction boxes 54, into the second extended nip NP2, after which the press arrangement and the transfer of the web are similar to that described above in relation to FIG. 1.

The embodiment in FIG. 2 differs from the embodiment in FIG. 1 above all in the respect that in FIG. 2 only one extended-nip zone NP1 is used, after which the web W is arranged to follow the upper felt 20 by the effect of the vacuum effective in the suction zone 27*a* of the transfer suction roll 27. Thereafter, the continued passage and adherence of the web W on the lower face of the upper felt 20 is secured by means of two successive suction boxes or blow-suction boxes 28, after which, on the run of the web W, there follows the gently loaded transfer nip NS, described above, in connection with the first drying cylinder 82*a* or equivalent. In FIG. 2, the guide roll 32S (the one denoted in FIG. 2) of the lower felt 30 is arranged so that its position can be adjusted by appropriate adjustment means, and likewise the guide roll 22S (the one denoted in FIG. 2) of the upper felt 20. This adjustment of the position is illustrated schematically by the arrows S. By means of the adjustment S, it is possible to set the magnitudes of the curve sectors of the felts 20,30 on the transfer suction roll 27 and on the drying cylinder 82*a* or equivalent.

The press section shown in FIG. 3 and the web transfer arrangement applied in its connection are in most respects similar to that shown in FIG. 2 except that the transfer suction roll 27 placed after the extended-nip zone NP1 in FIG. 2 has been substituted for by means of a press roll 27 having a smooth-face 27' and which forms a transfer nip NS0 together with a press roll 37 having a hollow-face 37' arranged inside the loop of the lower wire 30. The smooth face 27' of the upper press roll 27A and the hollow face 37' of the backup roll 37 have the effect that, owing to the rotation of the rolls 27A,37, such differences in pressure are induced as attempt to shift the web W toward the upper felt 20 and to keep the web W in contact with the upper felt 20. In the other respects, the transfer arrangement is similar to that described above in relation to FIG. 2.

In FIG. 4, after the dewatering extended nip NP1, a transfer nip NS0 similar to that described above in relation to FIG. 3 is also employed. Differing from the embodiment in FIG. 3, additionally a second transfer nip NS01 and a transfer belt 50B are employed, which belt 50B is smooth-faced and impermeable and substantially does not receive water, i.e., a substantially non-water-receiving belt. The second transfer nip NS01 is formed between a lower press roll 59B having a smooth-face 59' and an upper press roll 29A having a hollow-face 29'. Owing to the difference between the faces 29',59' of the rolls 59B and 29B, a difference in pressure is formed in the transfer nip NS01, which difference attempts to shift the web W toward the lower fabric 50B and to keep the web W in contact with the lower fabric 50B. On the transfer belt 50B, the web W is passed onto the drying wire 80 in the manner described above. The face of the transfer belt 50B is kept clean by a doctor 57 placed in connection with the guide roll 52. In connection with the transfer belt 50B, there can also be other devices for web tensioning, conditioning, etc.

In FIGS. 1–4, water drain troughs 26,36,46,56 are arranged at the outlet sides of the extended nips NP1 and NP2 and collect water drained from the web W and separated onto the roll faces 25',45',201 and pass this waters further to the side of the paper machine.

The press sections shown in FIGS. 1–4 are either press sections provided with one separate nip, as a rule an extended nip NP1 (FIGS. 2, 3 and 4), or so-called tandem press sections in which there are two or more separate nips NP1 and NP2 (FIGS. 1 and 1A). If just one nip NP1 is employed, in the present invention it is expressly an extended nip. On the other hand, if two or more successive press nips are employed as tandem, the last nip (the nip NP2 in FIG. 1 and the nip NPN in FIGS. 5 and 6) is an extended nip, and the preceding nip or nips is/are extended nips and/or roll nips, i.e., there may be a single extended nip as the last press nip and a preceding conventional roll nip. This applies expressly to the description of the dewatering nips and not transfer nips.

It is also a characteristic feature of the press sections shown in FIGS. 1–4 that the run of the web from the pick-up point P onto the first drying cylinder 82*a* or an equivalent lead-in cylinder or onto the drying wire 80 is quite linear, preferably so that the largest angle of change in the direction of the web over the passage is smaller than about 15°.

Figure 5:
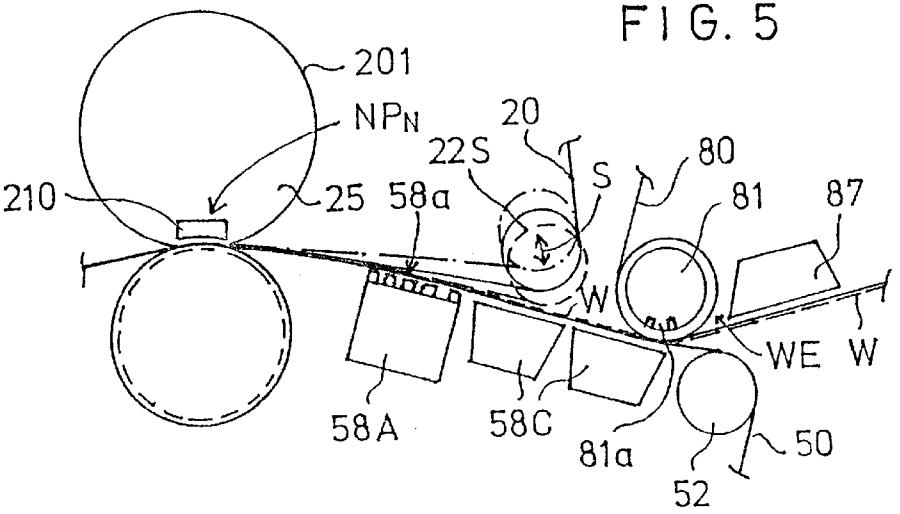
FIG. 5 illustrates an alternative embodiment of the transfer arrangement in accordance with the invention by means of suction boxes.
Figure 6:
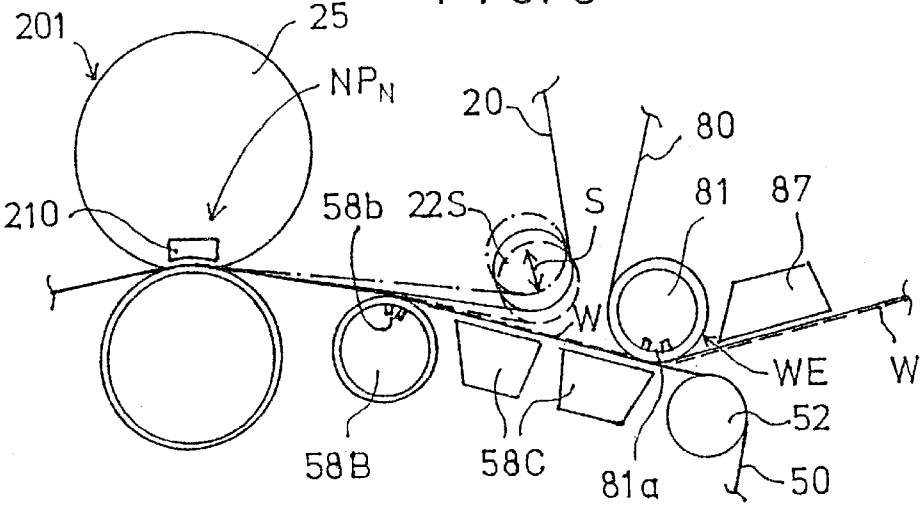
FIG. 6 shows such an embodiment of the transfer arrangement as shown in FIG. 5 in which the first transfer suction device is a transfer suction roll, instead of a transfer suction box.

FIGS. 5 and 6 show transfer arrangements in which the last nip $NP_N$ is an extended nip, wherein N represents the current number of the nip, which is generally in a range of 1 to 3 or sometimes even 4, in particular if one or several roll nips are employed instead of an extended nip. As shown in FIG. 5, after the nip $NP_N$, the web W is arranged to follow the lower felt 50 by the effect of the vacuum present in a curved deck 58*a* of a transfer suction box 58A. After the transfer suction box 58A, the continued passage and adherence of the web W on the top face of the lower felt 50 is secured by means of transfer suction boxes 58C, of which boxes the latter one extends to the beginning of, or entirely to the area of, the suction zone 81*a* of the transfer suction roll 81 of the drying wire 80. In FIGS. 5 and 6, the guide rolls 22S of the upper felt 20 are arranged so that their positions can be adjusted by suitable adjustment means, which adjustment is represented by the arrows S.

FIGS. 5 and 6 show three different positions of the upper fabric 20 and of its guide roll 22S, i.e., the intermediate position illustrated with solid lines, in which position the upper fabric 20 has a straight run from the extended nip $NP_N$. Dashed-dotted lines illustrate the extreme two positions of the upper fabric 20 and its guide roll 22S, i.e., the upper position in which the upper fabric 20 is completely apart from the suction zones 58*a*,58*b* of the suction devices 58A,58B. In the lower position illustrated by the dashed-dotted lines, the upper fabric 20 forms a turning sector on the suction zone 58*a*,58*b*, and the latter lower position is used for threading of the web W and possibly in other exceptional situations, whereas the intermediate position and the upper position of the fabric 20 are used in constant running operations. The upper position of the fabric 20 is the least rewetting position, and it is employed when permitted by the runnability of the web. With the adjustment described above, the curve angle is affected with which the felt 20 is curved over the transfer suction box 58A or, in FIG. 6, over the suction zone 58*b* of the transfer suction roll 58B placed in a corresponding position.

FIG. 7 shows a preferred arrangement of the suction zone 81*a* of the transfer suction roll 81 of the driving wire 80 for use in connection with the present invention. A corresponding arrangement can also be employed in other transfer suction rolls used in the invention, i.e., in the transfer suction rolls 33,41,47 shown in FIG. 1, in the transfer suction roll 27 of FIG. 2, and in the transfer suction roll 58B of FIG. 6. As shown in FIG. 7, the extension of the suction zone 81*a* of the transfer suction roll 81 is denoted with the letter a. Inside this sector a, there is a sector b which corresponds to the angle over which the drying wire 80 or an equivalent fabric is curved against the face of the roll 81 after the contact point with the lower fabric 50 or equivalent. Inside the sector a, there is also an open sector c not covered by the drying wire, which sector c represents the area of the suction zone 81*a* that is open after the point of separation of the drying wire 80 or equivalent (sector a=b+c). Through the open sector c, the suction effect of the suction zone 81*a* and the suction flow I can act upon the bottom of a wedge space WE opened after the roll 81 and the drying wire 80 or equivalent thus lowering the pressure level effective in this space, whereby the transfer of the web W onto the fabric 80 that carries it further is promoted. The fabric 80 is, in FIG. 1, the lower felt 30 and the upper felt 40 depending on which roll is the transfer suction roll, in FIG. 2, the upper felt 20, and in FIG. 6, the lower felt 50.

In the transfer method as shown in FIG. 7, the angle of contact of the press fabric 50 against the transfer suction roll 81 can be regulated so that during threading the contact angle is larger and during constant running smaller. The regulation can also be accomplished, for example, by means of an apparatus for displacing the guide roll 52, which is illustrated schematically by the arrow S. The positions of the lower fabric 50 and of its guide roll 52 illustrated by means of solid lines in FIG. 7 correspond to the threading position, and the positions indicated by the dashed-dotted lines represent the position of constant running.

In the present invention, in the suction sectors 27*a*,33*a*, 47*a*,58*b*,58*a*,81*a* of the transfer suction rolls 27,33,47,58B, 81 or equivalent suction boxes 58A, in constant running of the machine, a difference in pressure is employed that is selected high enough to secure a reliable draw of the web W, but low enough so that the suction does not rewet the web W to a substantial extent. For this purpose, the vacuum level in the suction zones is typically set in a range of about −2 kPa to about −30 kPa, preferably in a range of from about −3 kPa to about −20 kPa.

In the following, the most important features and the most advantageous embodiments of the web transfer method disclosed herein will be described.

In the introductory portion of the present specification, drawbacks of transfer arrangements in paper machines were described that arise from the fact that the vacuum in a transfer suction device causes rewetting of the web W. The extent of this rewetting depends on the vacuum level that is employed and on the common curve sectors of the dewatering felts over the face subjected to a vacuum and the web W. With a view toward minimizing the rewetting, in the method disclosed herein, in the web W threading, in the transfer suction rolls 33,47,27,58B or in equivalent transfer suction boxes of blow-suction boxes 58A and possibly also in other transfer suction boxes or blow-suction boxes 34,43, 48,28,58C,85, higher vacuum levels are used than during constant running, in which connection the vacuum levels in the suction devices are lowered to such a level that adequate runnability is maintained. Also, in the method disclosed herein, the curve sectors or the angles of change in direction of the dewatering felts running over the transfer suction devices are adjusted to be larger in connection with threading than during constant running. In such a case, during constant running, as is shown in FIG. 7, the vacuum zone 81*a* or the corresponding vacuum zones in other suction devices extend beyond the curve sectors of the fabrics 50,80 in the running direction of the web W. When a transfer suction roll is used as the transfer device, in order to avoid rewetting of the web W the roll is provided with suction-sector sealing ribs preferably with no water lubrication and with seal locking devices. During constant running, the low vacuum employed in a transfer suction device and the small curve sectors of the dewatering felts permit the differences in speed necessary for tensioning the web W and reduce the lowering of the dry solids content in the web W after the nip, produced by the transfer suction devices.

For the purposes stated above, the vacuum levels in the different suction zones 27*a*,33*a*,47*a*,58*a*,58*b*,81*a* are, during threading generally set in a range from about −5 kPa to about −45 kPa, preferably in a range of from about −7 kPa to about −30 kPa, whereas during constant running the corresponding vacuums are typically set in a range from about −2 kPa to about −30 kPa, preferably in a range from about −3 kPa to about −20 kPa. Alternate ranges for the vacuum levels in the different suction zones may be from about −2 kPa to about −45 kPa and preferably from about −3 kPa to about −25 kPa.

The examples provided above are not meant to be exclusive. Many other variations of the present invention would be obvious to those skilled in the art, and are contemplated to be within the scope of the appended claims.

I claim:

1. An arrangement for transferring a paper web in paper machines including a forming section, a press section arranged after the forming section and a dryer section arranged after the press section, the press section including at least one press nip zone for dewatering the web, the web being passed through a last one of said at least one press nip zone in a machine direction between first and second water-receiving press fabrics such that draining of water out of the web takes place through both faces of the web in the last press nip zone, the arrangement comprising separating means for separating the first press fabric from the web after the last press nip zone such that the web is subsequently carried only on the second press fabric after the last press nip zone, said separating means comprising a first transfer nip formed by a first press roll arranged in a loop of the first press fabric and a second press roll arranged in a loop of the second press fabric such that the first and second press fabrics pass through the first transfer nip, a second transfer nip arranged after the last press nip zone, the web being carried on the second press fabric into said second transfer nip, and a substantially non-water receiving transfer belt arranged to run through said second transfer nip, the web being transferred in said second transfer nip from the second press fabric to said transfer belt, said transfer belt having a face more adhesive to the web than the second press fabric, the web being transferred from said transfer belt onto a drying wire in the dryer section as a closed draw.

2. The arrangement of claim 1, wherein the first press fabric is a lower fabric in said last press nip zone and the second press fabric is an upper fabric in said last press nip zone.

3. The arrangement of claim 1, wherein the second press fabric is an upper press fabric which carries the web on a lower face, the web being carried on said lower face of said upper fabric in an upwardly inclined run into said second transfer nip.

4. The arrangement of claim 1, wherein one of said first and second press rolls is a smooth-faced press roll and the other of said first and second press rolls is a hollow-faced press roll.

5. The arrangement of claim 1, further comprising at least one suction box arranged in a loop of the second press fabric between said separating means and said second transfer nip for ensuring adherence of the web to the second press fabric before said transfer nip.

6. The arrangement of claim 2, wherein said second transfer nip is formed by an upper hollow-faced press roll arranged inside a loop of the second press fabric and a lower press roll arranged in a loop of said transfer belt.

7. The arrangement of claim 6, wherein said lower press roll is a smooth-faced press roll.

8. The arrangement of claim 6, further comprising means for setting a magnitude of curvature of the second press fabric about said lower press roll.

9. The arrangement of claim 8, wherein said setting means comprise a movable guide roll arranged in the loop of the second press fabric after said upper press roll.

10. The arrangement of claim 1, wherein the last press nip zone is an extended nip zone.

11. The arrangement of claim 1, wherein said separating means are structured and arranged to generate a pressure difference to effect the separation of the first press fabric from the web and the subsequent carrying of the web only on the second press fabric such that the web is not rewet through contact with the first press fabric after the separation of the first press fabric from the web.

12. A method for transferring a paper web in paper machines including a forming section, a press section arranged after the forming section and a dryer section arranged after the press section, the press section including at least one press nip zone for dewatering the web, the web being passed through a last one of said at least one press nip zone in a machine direction between first and second water-receiving press fabrics such that draining of water out of the web takes place through both faces of the web in the last press nip zone, the method comprising the steps of:

separating the first press fabric from the web after the last press nip zone such that the web is subsequently carried only on the second press fabric after the last press nip zone, said step of separating the first press fabric from the web comprising the step of forming a first transfer nip between a first press roll arranged in a loop of the first press fabric and a second press roll arranged in a loop of the second press fabric such that the first and second press fabrics are passed through the first transfer nip, carrying the web on the second press fabric into a second transfer nip arranged after the last press nip zone, guiding a substantially non-water receiving transfer belt through said second transfer nip in contact with the web and transferring the web in said second transfer nip from the second press fabric to said transfer belt, said transfer belt having a face more adhesive to the web than the second press fabric, transferring the web from said transfer belt onto a drying wire in the dryer section as a closed draw.

13. The method of claim 12, wherein the first press fabric is a lower fabric in said last press nip zone and the second press fabric is an upper fabric in said last press zone.

14. The method of claim 12, further comprising the step of:

arranging at least one suction box in a loop of the second press fabric after the web is separated from the first press fabric and before said second transfer nip for ensuring adherence of the web to the second press fabric before said second transfer nip.

15. The method of claim 13, wherein said second transfer nip is formed by an upper hollow-faced press roll arranged inside a loop of the second press fabric and a lower press roll arranged in a loop of said transfer belt.

16. The method of claim 15, further comprising the step of:

setting a magnitude of curvature of the second press fabric about said lower press roll.

17. The method of claim 16, wherein said setting step comprises the step of adjusting a position of a guide roll arranged in the loop of the second press fabric after said upper press roll.

18. The method of claim 12, wherein the last press nip zone is an extended nip zone.

19. The method of claim 12, further comprising the step of:

in conjunction with the separation of the web from the first press fabric, generating a pressure difference to effect the separation of the first press fabric from the web and the subsequent carrying of the web only on the second press fabric such that the web is not rewet through contact with the first press fabric after the separation of the first press fabric from the web.

20. The method of claim 12, wherein one of said first and second press rolls is a smooth-faced press roll and the other of said first and second press rolls is a hollow-faced press roll.

* * * * *